US005088426A

United States Patent [19]

Ogawa

[11] Patent Number: 5,088,426

[45] Date of Patent: * Feb. 18, 1992

[54] SEWING MACHINE WITH AUTOMATIC THREAD TAKE-UP AND THREADING

[75] Inventor: Masao Ogawa, Nagoya, Japan

[73] Assignee: Brother Kogyo Kabushiki Kaisha, Aichi, Japan

[ * ] Notice: The portion of the term of this patent subsequent to Feb. 11, 2009 has been disclaimed.

[21] Appl. No.: 592,832

[22] Filed: Oct. 4, 1990

[30] Foreign Application Priority Data

Oct. 9, 1989 [JP] Japan ..... 1-263608

[51] Int. Cl.[5] ..... D05B 87/02

[52] U.S. Cl. ..... 112/225; 112/243

[58] Field of Search ..... 112/224, 225, 302, 241, 112/242, 243; 223/99

[56] References Cited

U.S. PATENT DOCUMENTS 4,355,591 10/1982 Itoh et al. ..... 112/225
4,461,409 7/1984 Itoh et al. ..... 112/225
4,893,573 1/1990 Moriya ..... 112/225

FOREIGN PATENT DOCUMENTS 63-89194 4/1988 Japan .
1-113092 5/1989 Japan .

*Primary Examiner*—Peter Nerbun

*Attorney, Agent, or Firm*—Oliff & Berridge

[57] ABSTRACT

A sewing machine for automatic thread taking-up and threading comprising a guide groove for guiding a needle thread to a threading preparatory position in the vicinity of a needle bar via a thread taking-up preparatory position intersecting a thread take-up moving area, a sewing machine motor driver for extracting the needle thread along the thread take-up moving area and for instructing a thread take-up to catch the needle thread, a pulse motor driver for threading the needle thread to an eye of a needle, a threading switch for generating signals, and an electronic control circuit for controlling the pulse motor driver and the sewing machine driver at prescribed timings in response to the signals from the threading switch. In the sewing machine, an operator has only to prepare a needle thread along the guide groove and push the threading switch. The electronic control circuit then controls the pulse motor driver and the sewing machine driver for the thread taking-up operation and the threading operation, respectively. Any operator can operate the sewing machine with easiness because the thread take-up operation and the threading operation are automatically performed without complicated cam mechanism or linkage mechanism. In addition, the sewing machine is easy to manufacture and the timing of operations can easily be adjusted.

20 Claims, 19 Drawing Sheets

SEWING MACHINE WITH AUTOMATIC THREAD TAKE-UP AND THREADING

BACKGROUND OF THE INVENTION

The present invention relates to a sewing machines which include automatic needle threading and, more specifically, to apparatus for including in a sewing machine to provide automatic thread taking-up and threading.

Sewing machines including the capability to self-thread the needle thereof are known in the art and greatly appreciated by those using them as they are no longer required to manually insert the thread through the eye of the needle. Such a sewing machine is disclosed in Japan Published Unexamined Patent Application No. S63-89194 which is owned by the common assignee of this application. In that sewing machine, the operation of taking up the tread and threading it through the eye of the needle are simplified over manual threading. Specifically, the sewing machine semi-automatically threads the eye of the needle when an operating member provided at the front face of the sewing machine head is pressed. Since a thread taking-up member is connected to the operating member, the thread taking-up operation can be semi-automatically accomplished, too. In this semi-automated apparatus, however, the threading member, the thread taking-up member, and the operating member are interlocked using a complicated linkage mechanism and cam mechanism. The operator often has to quickly press the operating member with a rather strong force such that the linkage mechanism and the cam mechanism will operate smoothly. Unfortunately, sometimes only an experienced operator can do this successfully. In addition, the designing of the linkage mechanism and the cam mechanism and the adjusting of the interlocking of the various members is difficult and troublesome work.

Wherefore, it is an object of this invention to provide a needle-threading apparatus for a sewing machine with is fully automatic in design and operation.

It is another object of this invention to provide a needle-threading apparatus for a sewing machine which is simple in design.

It is still another object of this invention to provide a needle-threading apparatus for a sewing machine which is easy to operate and which does not require particular strength or skill on the part of an operator.

Other objects and benefits of the invention will become apparent from the detailed description which follows hereinafter when taken in conjunction with the drawing figures which accompany it.

SUMMARY OF THE INVENTION

To attain the foregoing objects, this invention provides a sewing machine for automatic thread taking-up and threading which comprises, as shown in FIG. 1, needle thread guide means M1 for guiding a needle thread w from a needle thread supply source w1 to a threading preparatory position P2 near the end of a needle bar w3 via a thread taking-up preparatory position P1 intersecting a thread take-up moving area w2, thread taking-up prosecute means M2 for extracting the needle thread w at the thread taking-up preparatory position P1 along the thread take-up moving area w2 and for taking-up the needle thread w using a thread taking-up member w4 and/or a thread take-up w5 both provided at one end of the thread take-up moving area w2, and threading prosecute means M3 for threading the needle thread w at the threading preparatory position P2 to an eye w7 of a needle w6 provided at the lower end of the needle bar w3. The sewing machine for automatic thread taking-up and threading further comprises signal generating means M4 provided at a sewing machine body or peripheral units for generating signals when operated, and thread taking-up and threading control means M5 for controlling the threading prosecute means M3 and thread taking-up prosecute means M2 at prescribed timings in response to the signals from the signal generating means M4.

In the sewing machine for automatic thread taking-up and threading of the present invention constructed as above, the needle thread guide means M1 guides the needle thread w from the needle thread supply source w1 to the thread taking-up preparatory position P1 and the threading preparatory position P2, and when the signal generating means is operated the thread taking-up and threading control means M5 controls the threading prosecute means M3 and thread taking-up prosecute means M5 at prescribed timings in response to signals from the signal generating means. As a result, the needle thread w is threaded to the eye w7 of the needle w6 by the threading prosecute means M3 and is taken up by the thread taking-up member w4 and/or the thread take-up w5.

DETAILED DESCRIPTION OF THE PREFERRED EMBODIMENT

Sewing machines for automatic thread taking-up and threading embodying the present invention are described in detail with reference to the attached drawings.

Figure 1:
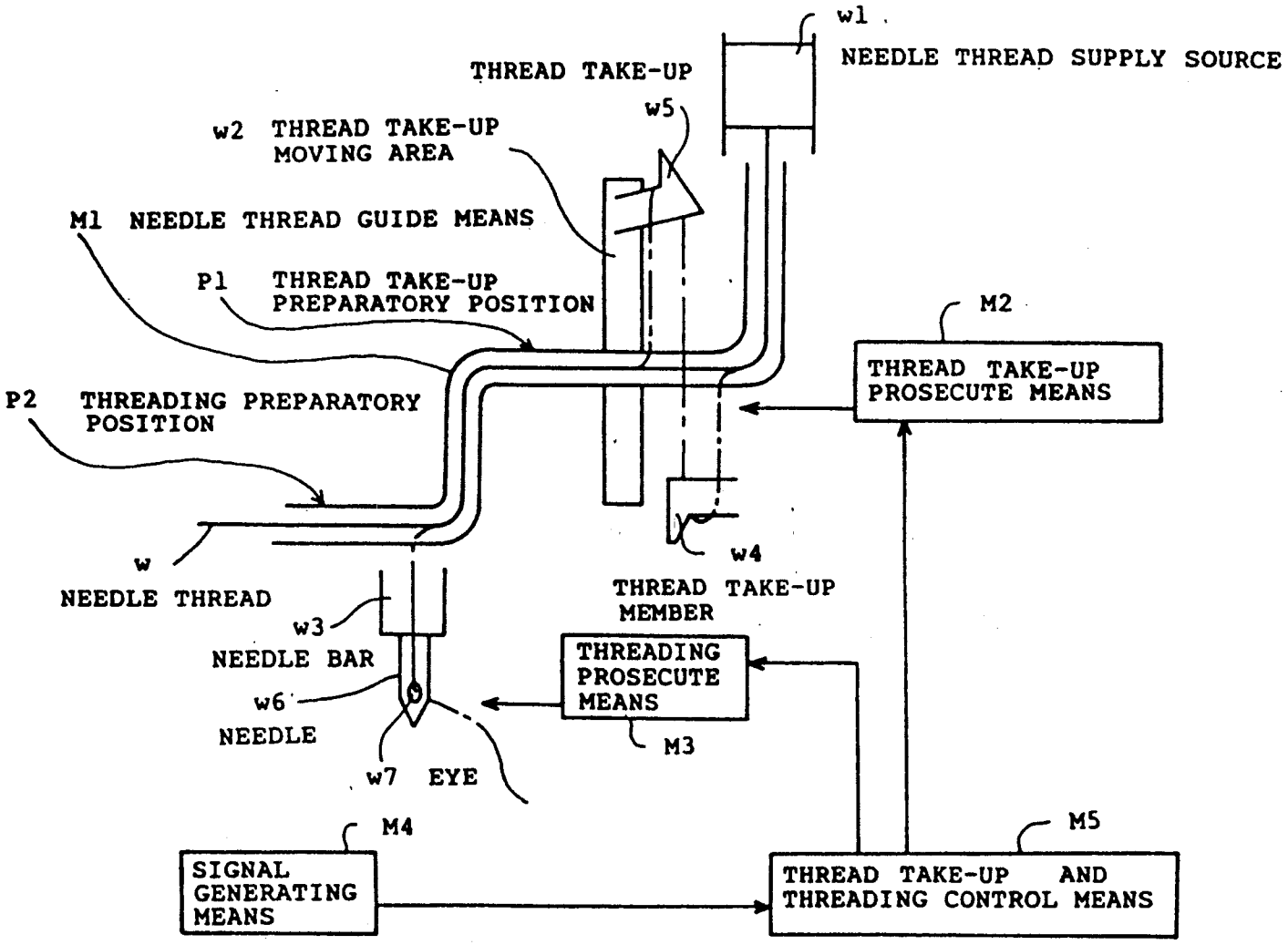
FIG. 1 is a greatly simplified and partial functional block diagram showing the construction of a sewing machine with automatic thread taking-up and threading according to the present invention.
Figure 2:
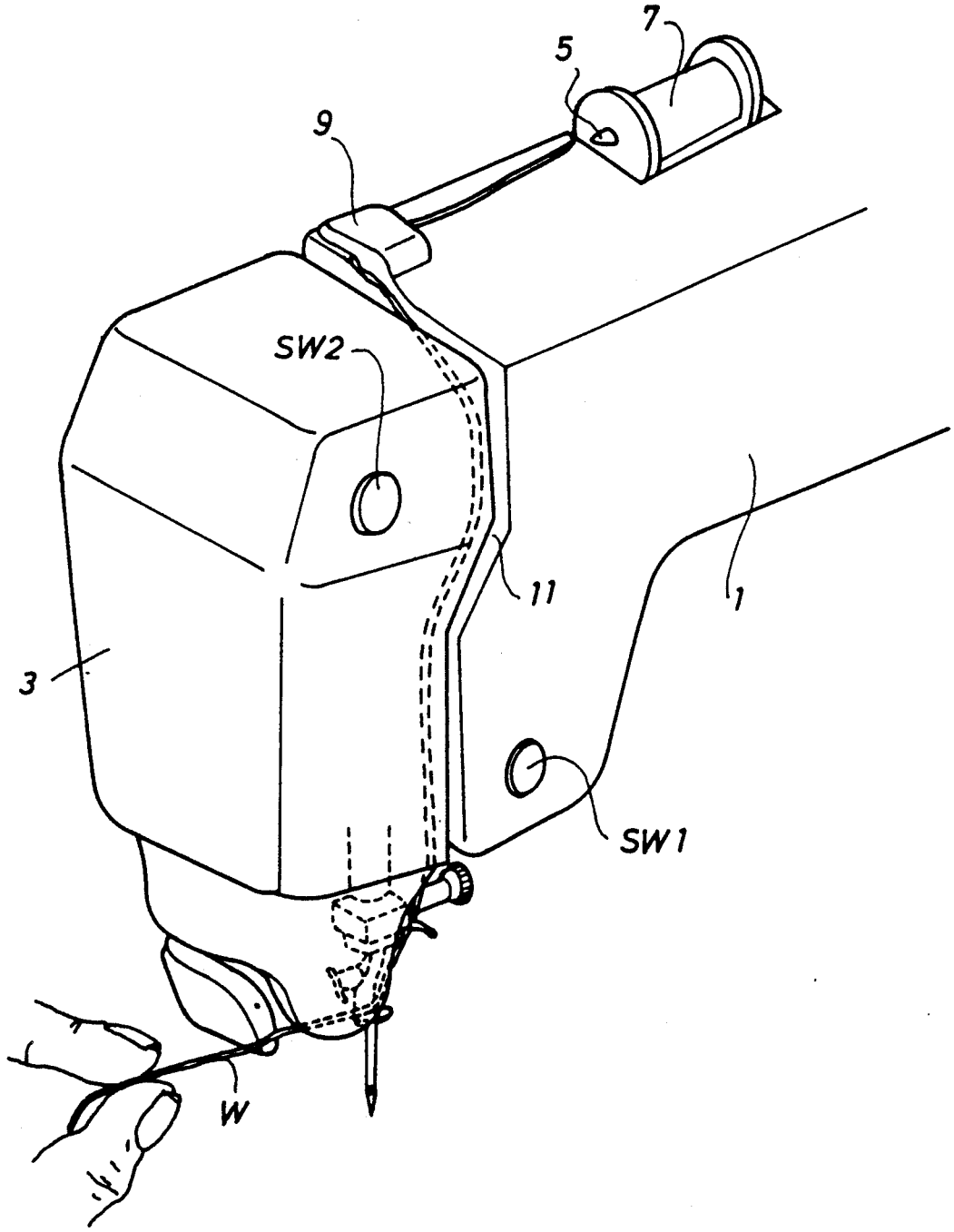
FIG. 2 is a perspective view of a sewing machine with automatic thread taking-up and threading of the present invention in a first embodiment.

FIG. 2 is a perspective view showing a head 1 of the sewing machine for automatic thread taking-up and threading seen from the side of a face plate 3.

On the top face of the head 1 an arm spool pin 5 and a top thread holder 9 are provided. A bobbin 7 is put on the arm spool pin 5, and a needle thread w from the bobbin 7 is held by the top thread holder 9 and led to the front of the head 1. A guide groove 11 beginning directly before the top thread holder 9 intersects the top face, extends downward in the front face of the head 1, passes under the face plate 3, and ends at the rear of the face plate 3.

On both sides of the guide groove 11 on the front face of the head 1, a start switch SW1 and a threading switch SW2 are attached. The start switch SW1 at a lower position instructs the start of sewing operating. The threading switch SW2 at a higher position instructs thread taking-up operating by a thread take-up and threading operating to an eye of a needle, both of which are explained later.

Figure 3:
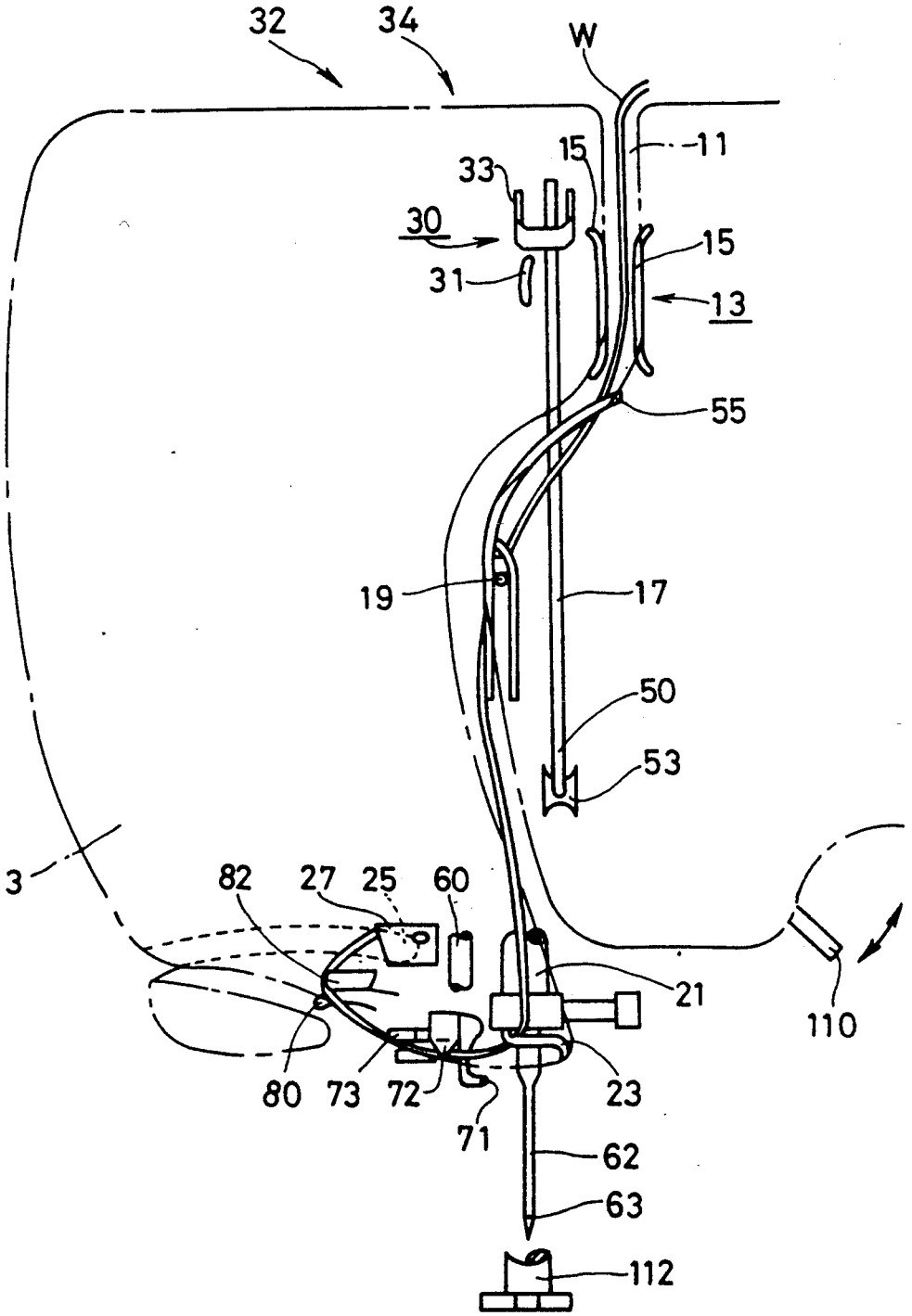
FIG. 3 is a front view showing a guide groove of the sewing machine of the first embodiment.

As shown in FIG. 3, a front view, the guide groove 11 passes between a pair of tension discs 15 of a tension member 13, obliquely intersects approximately middle portion of a thread guide 17 above a thread take-up spring 19, and goes around a needle-bar thread guide 23 provided under a needle bar 21. Further, the guide groove 11 passes under the front portion of the face plate 3 and ends at a terminal 25 at the rear of the face plate 3. A thread cutter 27 is attached to the terminal 25 of the guide groove 11.

Inside of the head 1 a thread take-up 30 is provided in the front portion of the guide groove 11 so as to swing vertically in front of the thread guide 17. The thread take-up 30 comprises a claw 31 bent upward for catching the needle thread w, a cover rod 32 provided over the claw 31, and a pressing cover 33 fixed to the cover rod 32. The claw 31 and the pressing cover 33 form a thread holding hole 34. Seen from the face plate 3, the thread holding hole 34 is a slightly curved narrow hole, as shown in FIG. 4C.

Figure 4B:
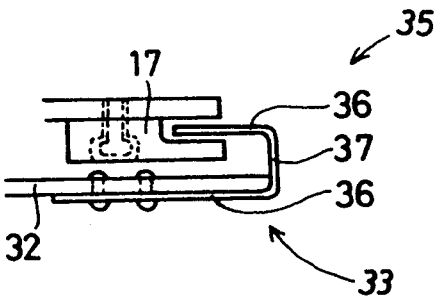
FIG. 4B is a partial flat view of the thread take-up.
Figure 4C:
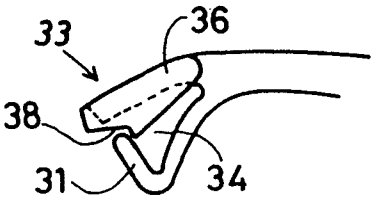
FIG. 4C is a partial rear view of the thread take-up.

The pressing cover 33 is almost U-shaped in cross section seen from the top and surrounds the thread guide 17, as shown in FIG. 4B. A front panel 35, a rear panel 36, and a connecting panel 37 compose the pressing cover 33. The front panel 35 is positioned in front of the thread guide 17 and the rear panel 36 is behind the thread guide 17. The connecting panel 37 connects the front panel 35 and the rear panel 36.

The claw 31 contacts with the front panel 36 at its tip and is slightly curved toward the thread guide 17, as shown in FIG. 3. A notch 38 is formed in the rear panel 36, as shown in FIG. 4C, such that the tip of the claw 31 projects beyond the pressing cover 33 through the notch 38.

Figure 4A:
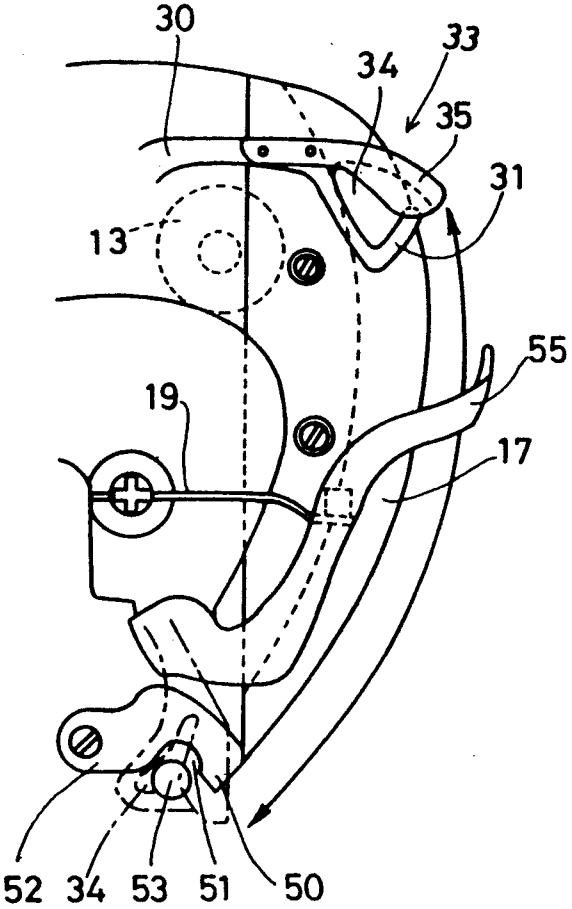
FIG. 4A is a front view of a thread take-up of the sewing machine of the first embodiment.
Figure 5:
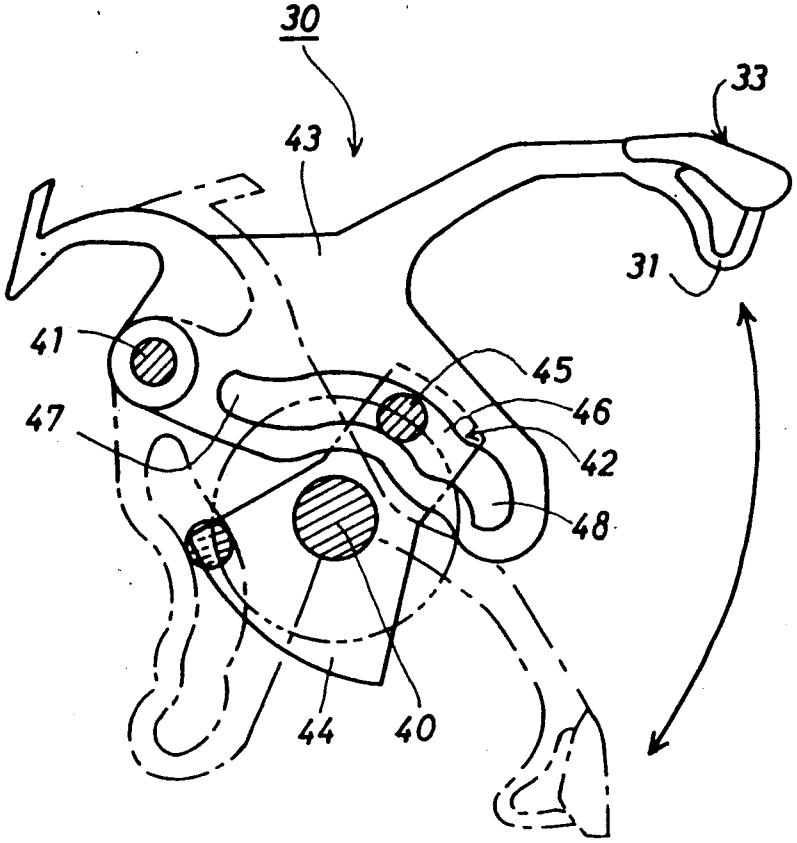
FIG. 5 explains the operating of the thread take-up.

As shown in FIG. 5, a base 43 of the thread take-up 30 is rotatably mounted on an auxiliary shaft 41. The auxiliary shaft 41 is parallel with an arm shaft 40. The base 43 has a cam slot 42 through it extending from adjacent the auxiliary shaft 41. A crank pin 45 of a thread take-up crank 44 fixed to the arm shaft 40 is movable in the cam slot 42. The cam slot 42 has three portions; an arc portion 46 in the middle, a linear portion 47 at one end near the auxiliary shaft 41, and a short arc portion 48 at the other end. The arc portion 46 has a curvature approximately equal to that of the partial circle made by the rotation of the crank pin 45. The curvature of the short arc portion 48 is smaller than that of the arc portion 46. By the engagement of the cam slot 42 with the crank pin 45, the thread take-up 30 moves as indicated by the arrow in FIG. 5 when the arm shaft 41 is rotated. The relative positions of the cam slot 42 and the crank pin 45 are adjusted such that the thread take-up 30 goes down below a lower end portion 50 of the thread guide 17, as shown by a dashed line in FIG. 4A.

At the lower end portion 50 of the thread guide 17 a thread receiver 52 is positioned, as shown in FIG. 4A. The thread receiver 52 has a dent 51 in its lower portion. A press roller 53 disposed in the dent 51 is brought close to or apart from the thread receiver 52 by a cam mechanism (not shown) during the sewing operating, thus adjusting the tension of the needle thread w. A guide member 55 is interposed between the thread take-up 30 and the thread receiver 52 so as to cover a thread take-up spring 19 and a portion of the thread guide 17.

As shown in FIG. 3, a lower end of a threading member shaft 60 is positioned near the curved portion of the guide groove 11 at the bottom of the face plate 3. The threading member shaft 60 is parallel to the needle bar 21. The following is an explanation of the threading member shaft 60.

Figure 6:
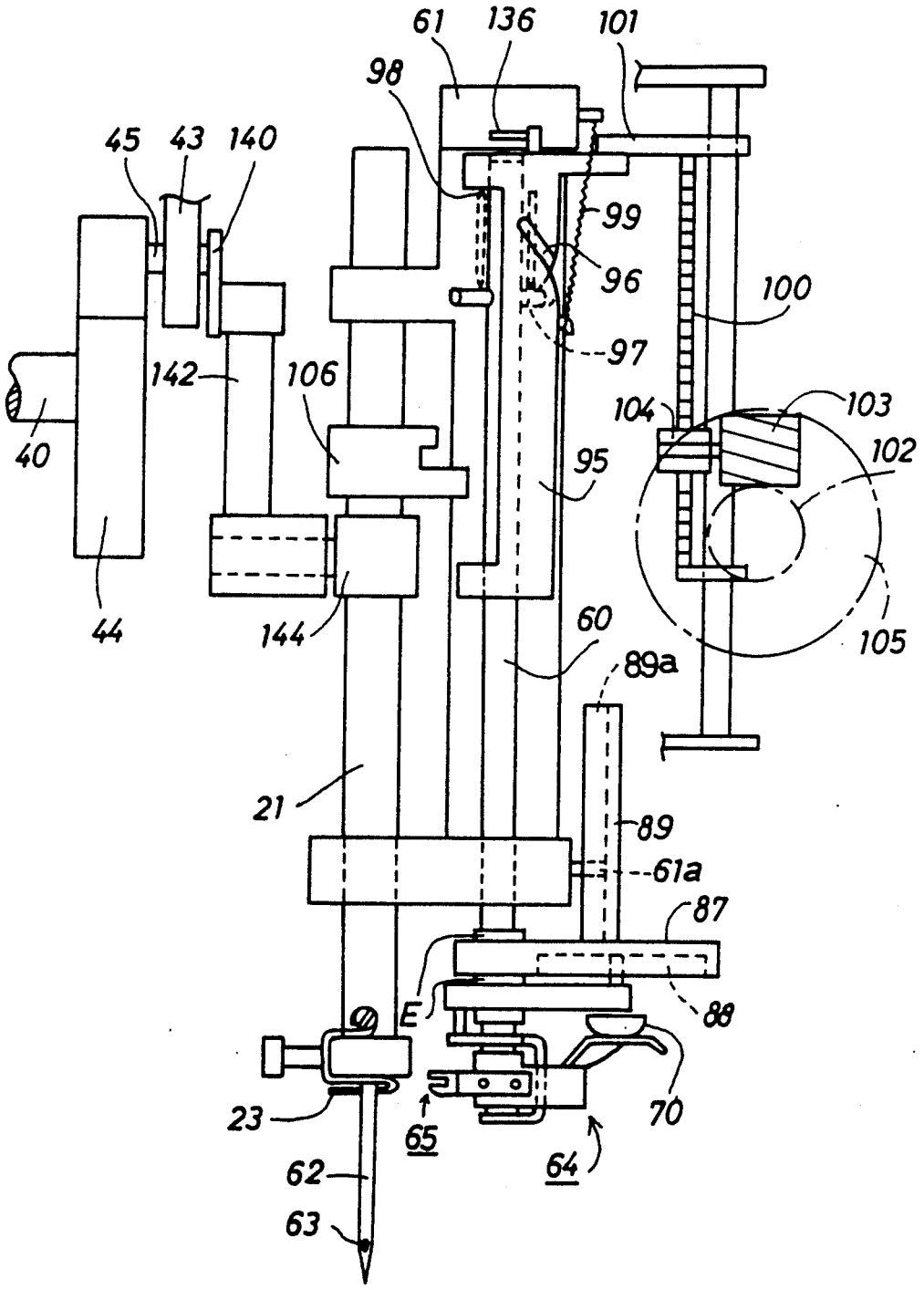
FIG. 6 is a rear view showing a needle bar and a threading member shaft provided in the head of the sewing machine of the first embodiment.

FIG. 6 shows the inside of the face plate 3. A frame body 61 supports the needle bar 21 and the threading member shaft 60. The threading member shaft 60 is vertically movable along an axis parallel to that of the needle bar 21 and is also rotatable about that axis. The threading member shaft 60 is connected to a thread positioning member 64 and a threading member 65. The thread positioning member 64 strings the needle thread w in front of the eye 63 of a needle 62 by the cooperating of a guide mechanism and a linkage mechanism (to be described later), when the threading member shaft 60 is vertically moves and rotated. The threading member 65 introduces the strung needle thread w into the eye 63.

Figure 7A:
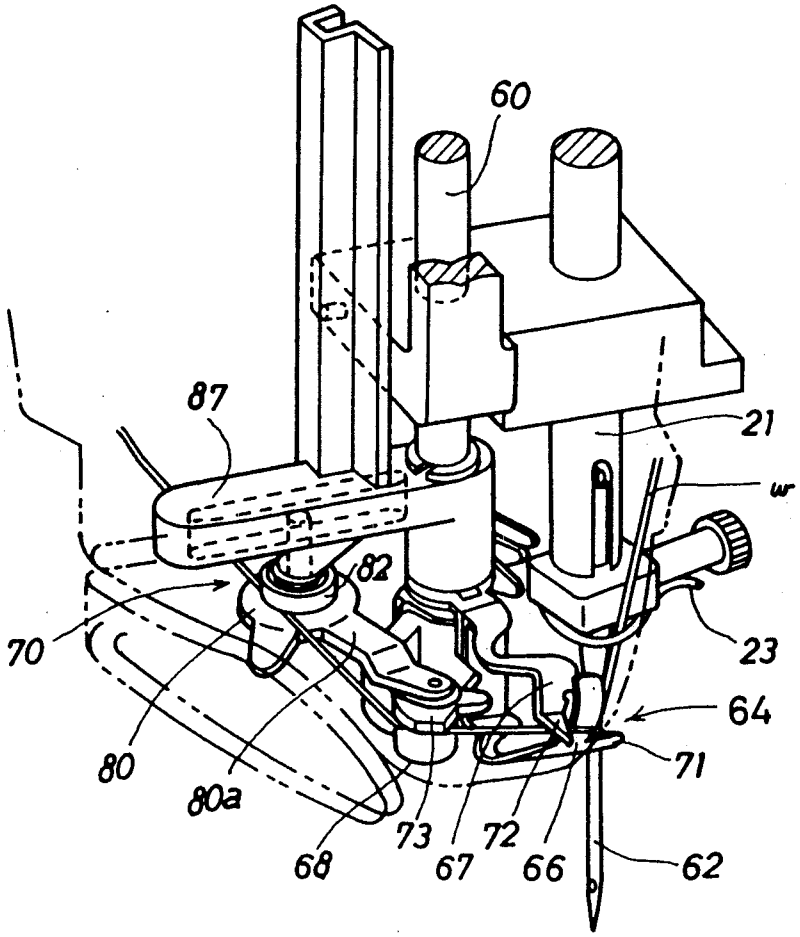
FIG. 7A is a perspective view of a thread tension member provided at the lower end of the threading member shaft.

As shown in FIG. 7A, the thread positioning member 64 is composed of a first positioning part 66 provided near the needle-bar thread guide 23, a second positioning part 67 provided behind the first positioning part 66, a third positioning part 68 provided behind the second positioning part 67 and a thread end keeping member 70 provided above and behind the three thread tension parts 66, 67 and 68. The thread tension parts 66, 67 and 68 are almost at the same height.

A thread holding protrusion 71 projects from the lower portion of the first positioning part 66 toward the needle bar 21. A pressing protrusion 72 is formed at the lower portion of the second positioning part 67, is positioned slightly above the thread holding protrusion 71 of the first positioning part 66, and projects forward beyond the first positioning part 66. In addition, a thread pressing piece 73 on the third thread tension portion 68 is at the same height of the thread pressing protrusion 72 of the second positioning part 67 and extends forward.

Figure 7B:
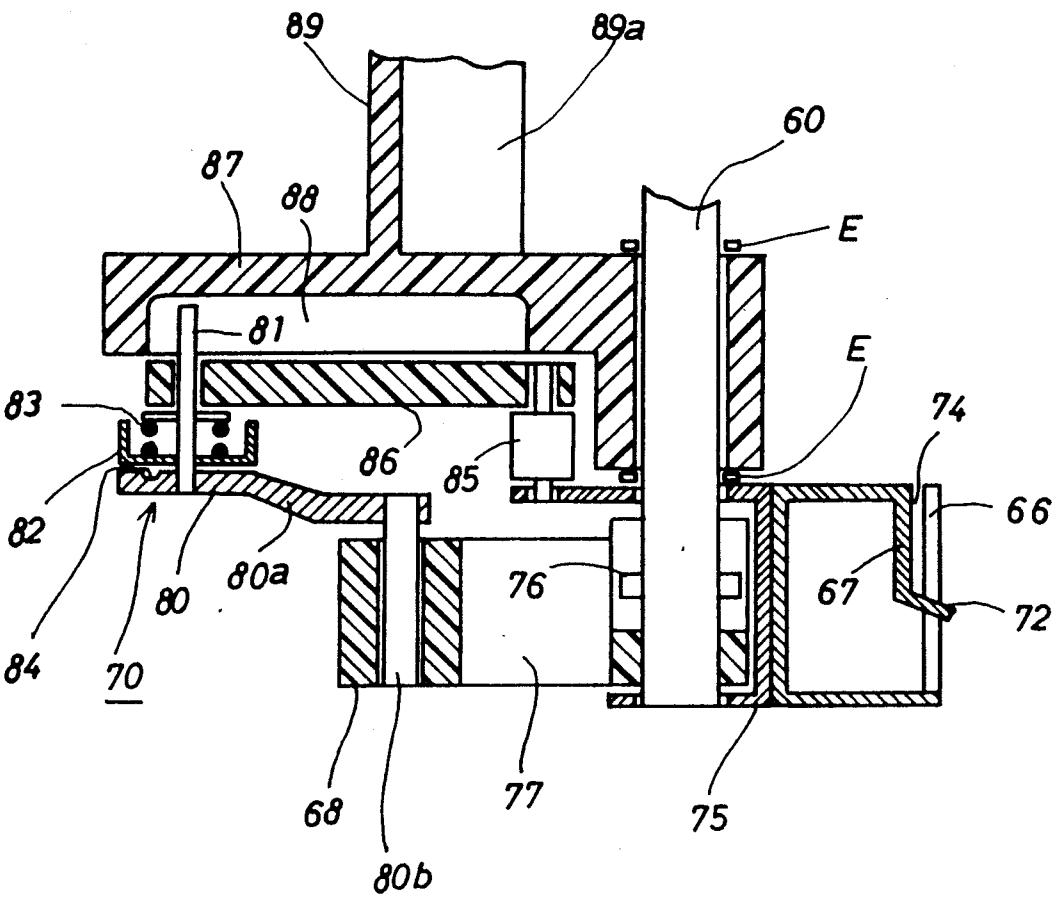
FIG. 7B is a cross-sectional view of the thread tension member.

Preferably, the first and the second thread tension part 66 and 67 are integrally molded and have an approximate square cross section, as shown in FIG. 7B. A part of the second positioning part 67, which is in communication with the thread pressing protrusion 72, extends in parallel to the first positioning part 66 with an appropriate space 74 therebetween. Both the first positioning part 66 and the second positioning part 67 are directly fixed to a U-shaped metal fitting 75, which is rotatable about the threading member shaft 60.

The third positioning part 68 is positioned at a free end of a rotating arm 77, whose other end is fixed to the threading member shaft 60 via a rotation stop pin 76.

The thread end keeping member 70 comprises a press plate 80 for pushing up the guided needle thread w and a press disc 82 freely movable on a support 81 extending upward from the press plate 80. The press disc 82 is forced downward by a spring 83 attached around the support 81. On the press plate 80, a receiving groove 84 is formed in a tangential direction with respect to the support 81 and in the vicinity thereof as shown.

The thread end keeping member 70 is rotatably supported by the third thread tension member 68 via a support shaft **80*b* which projects downward from an arm 80*a* integrally formed as part of the press plate 80**.

The end portion of the upper and longer leg of the U-shaped metal fitting 75 is loosely engaged with a deformed pin 85 having a larger-diameter portion in its longitudinally middle portion. The thread end keeping member 70 is connected to the U-shaped metal fitting 75 via a connecting lever 86 which is loosely engaged with the deformed pin 85 and the support 81 at its respective ends. The support 81 is slidable in a guide slot 88 formed in the bottom face of a slidable guide 87.

The slidable guide 87 freely rotates around the threading member shaft 60, and is prevented from moving vertically because of locating snap rings E positioned on and under the slidable guide 87. A vertical guide member 89 having a U-shaped cross section with a longitudinal groove **89*a* is fixed to the slidable guide 87, as shown in FIG. 6. A pin 61*a* projects horizontally from the bottom of the frame body 61 into the groove 89*a*. The guide member 89 and the slidable guide 87 thus integrally slide up and down the pin 61*a*. Consequently, the slidable guide 87 vertically moves the threading member shaft 60 via the guide member 89 and horizontally moves the support 81 via the guide slot 88** in its underside.

Figure 8:
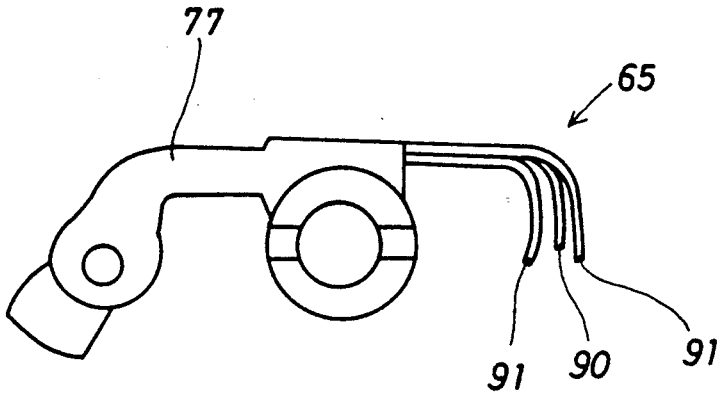
FIG. 8 is a top view of a part of the thread tension member and the threading member.
Figure 9:
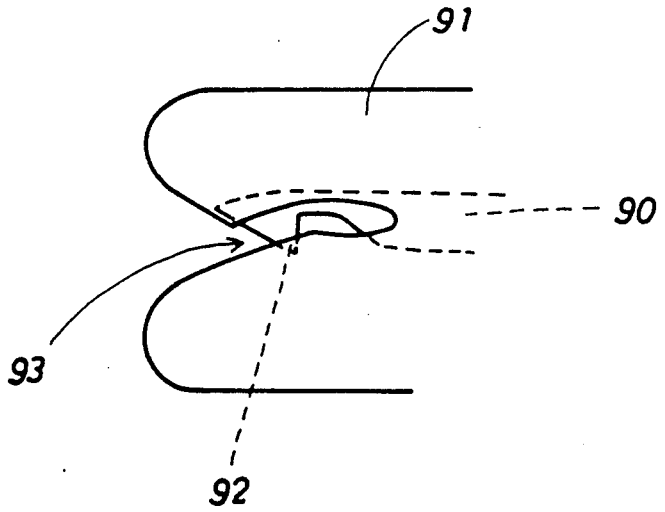
FIG. 9 is a partial side view of the threading member.

The threading member 65 at the rear end of rotating arm 77 comprises a threading hook 90 and a pair of hook guards 91. Seen from the top, the threading hook 90 extends to the right and bends to the front in its middle portion, as shown in FIG. 8. The pair of hook guards 91 are positioned on opposite sides of the threading hook 90 and are bent along the curve of the threading hook 90. As shown in FIG. 9, each of the hook guards 91 has a leading notch 93 in its end for leading the needle thread w towards a downward projection 92 of the threading hook 90.

The thread positioning member 64 and the threading member 65 having the aforementioned construction operate at their predetermined positions in exact timing with each other when the threading member shaft 60 moves vertically and rotates in a manner to be described shortly.

As best seen with reference to FIG. 6 once again, a guide member 95 is slidably provided on the upper portion of the threading member shaft 60. The guide member 95 has a cam notch 96 in the form of an elongated slot formed obliquely therein. One end of an engagement pin 97 penetrating the threading member shaft 60 is engaged with the cam notch 96. The threading member shaft 60 is biased upward by a spring 98 linking the top board of the guide member 95 and the engagement pin 97. Therefore, the engagement pin 97 normally abuts the lowest end of the cam notch 96.

The guide member 95 is connected to the top of the frame body 61 via a spring 99, thus also being biased upward. The top of the guide member 95 is pushed by a press board 101 provided at the upper end of a rack 100. The rack 100 is moved up and down in parallel to the threading member shaft 60 by a pulse motor 105 via gears 102, 103 and 104.

When the rack 100 descends, the threading member shaft 60 goes down together with the guide member 95 until the left end (as FIG. 6 is viewed) of the engagement pin 97 abuts an abutting member 106 fixed at a predetermined position on the needle bar 21. The position of the abutting member 106 is determined by the position of the eye 63 of the needle 62. Specifically, when the threading member shaft 60 is stopped by the abutting member 106, the threading hook 90 is as high as the eye 63. Subsequently, when the rack 100 further descends, the threading member shaft 60 is rotated because the engagement pin 97 moves in the cam notch 96.

In accordance with the aforementioned movement of the threading member shaft 60, the thread positioning member 64 and the threading member 65 operate as follows.

Figure 10A:
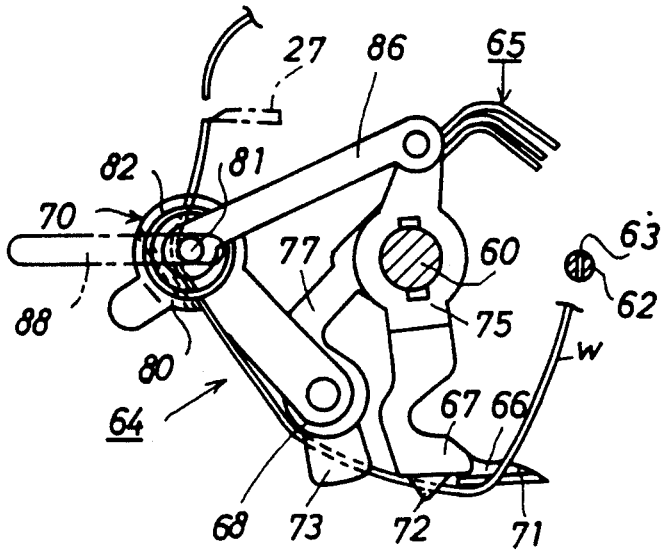
FIG. 10A through 10C are top views showing the operation of the thread tension member.
Figure 10B:
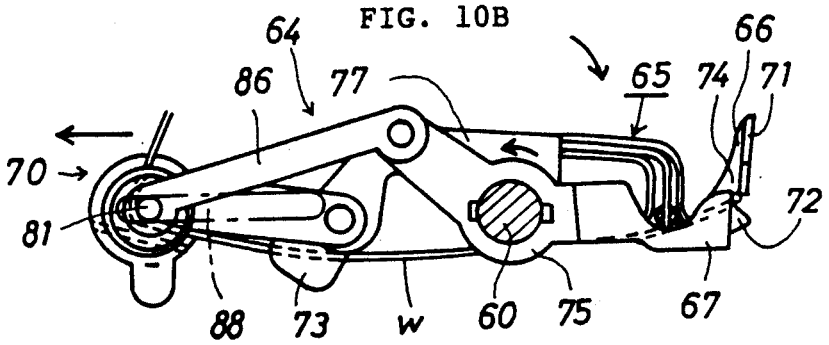
Figure 10C:
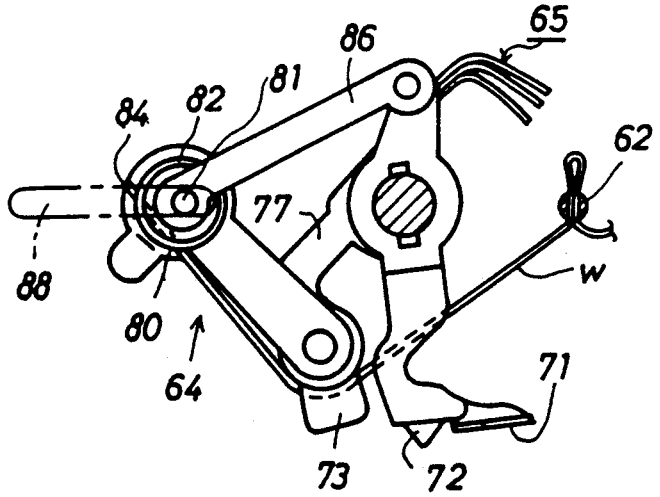

When the threading member shaft 60 rotates clockwise, the thread positioning member 64, the threading member 65, and other components shift from the condition shown in FIG. 10A to that in FIG. 10B. Specifically, the rotating arm 77 is rotated clockwise together with the threading member shaft 60, the press plate 80 is pushed leftward, and the support 81 slides leftward in the guide cavity 88. In addition, the U-shaped metal fitting 75, which is pulled by the connecting lever 86, rotates counterclockwise. As a result, the thread positioning member 64 is stretched and the distance between the first and second thread tension parts 66 and 67 and the thread end keeping member 70 becomes largest, as shown in FIG. 10B. As a result, the threading hook 90 is inserted through the eye 63 of the needle 62. Subsequently, the threading member shaft 60 is rotated counterclockwise and the thread positioning member 64 is contracted again, as shown in FIG. 10C, pulling the thread w.

The introduction of the needle thread w to the thread positioning member 64 along the guide groove 11 will now be explained with particular reference to FIGS. 2, 3, 7A and 10A.

By operating the presser-foot lever 110 provided on the head 1 behind the needle bar 21 on the head 1, the presser foot 112 is raised and the tension member 13 is opened. The free end of the needle thread w is then pulled from the bobbin 7, passed through the top thread holder 9, and is lead in the guide groove 11 from the front face to the rear face of the head 1. The needle thread w further is passed between the tension discs 15 of the tension member 13, the thread take-up spring 19, and the needle-bar thread guide 23. The needle thread w further passes over the thread holding protrusion 71 of the first positioning part 66, under the thread pressing protrusion 72 of the second positioning part 67, and under the thread pressing piece 73 of the third positioning part 68. After that, the needle thread w is inserted between the press plate 80 and the press disc 82 of the thread end keeping member 70, and is cut by the thread cutter 27.

By the foregoing operation, the needle thread w is thus positioned with respect to the thread positioning member 64, in the manner shown in FIG. 10A. Since the needle thread w reaches the terminal 25 of the guide groove 11, the needle thread w is securely held by the thread end keeping member 70 such that the needle thread w is in contact with the lower end of the support 81. The needle thread w is slightly slackened off in the guide groove 11.

Figure 11:
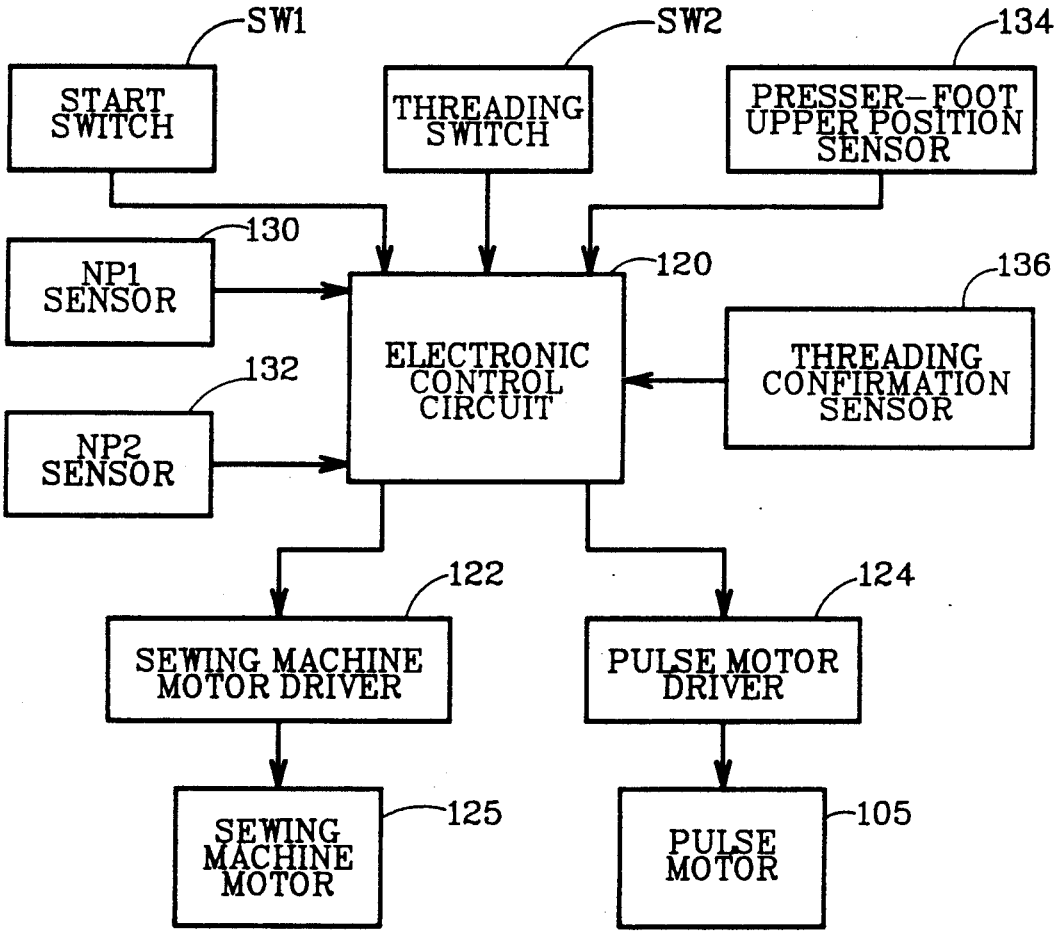
FIG. 11 is a block diagram of a control system for the first embodiment.

The control system of the sewing machine for automatic thread taking-up and threading will now be described with particular reference to FIG. 11.

The control system comprising CPU, ROM, RAM, and the like is mainly composed of an electronic control circuit 120 for controlling the thread taking-up operating, the threading operating, and the sewing operating. To the electronic control circuit 120, the start switch SW1 and the threading switch SW2 are connected at its input side, and a sewing machine motor 125 and the pulse motor 105 are connected at its output side via a sewing machine motor driver 122 and a pulse motor driver 124. An NP1 sensor 130 and an NP2 sensor 132 are also connected to the electronic control circuit 120. The NP1 sensor 130 sends out a detection signal when the needle bar 21 is at its highest position (hereafter referred to as NP1) as determined from the phase angle of the arm shaft 40. The NP2 sensor 132 sends out a detection signal when the thread take-up 30 is at its highest position (hereafter referred to as NP2), also determined from the phase angle of the arm shaft 40. Furthermore, to the electronic control circuit 120, a presser-foot upper position sensor 134 and a threading confirmation sensor 136 are connected. The presser-foot upper position sensor 134 sends out a detection signal when the presser foot 112 is raised using the presser-foot lever 110, in other words, when the tension member 13 is opened. The threading confirmation sensor 136 attached on the top of the guide member 95 sends out a detection signal when the upper end of the threading member shaft 60 projects beyond a predetermined position.

Figure 12:
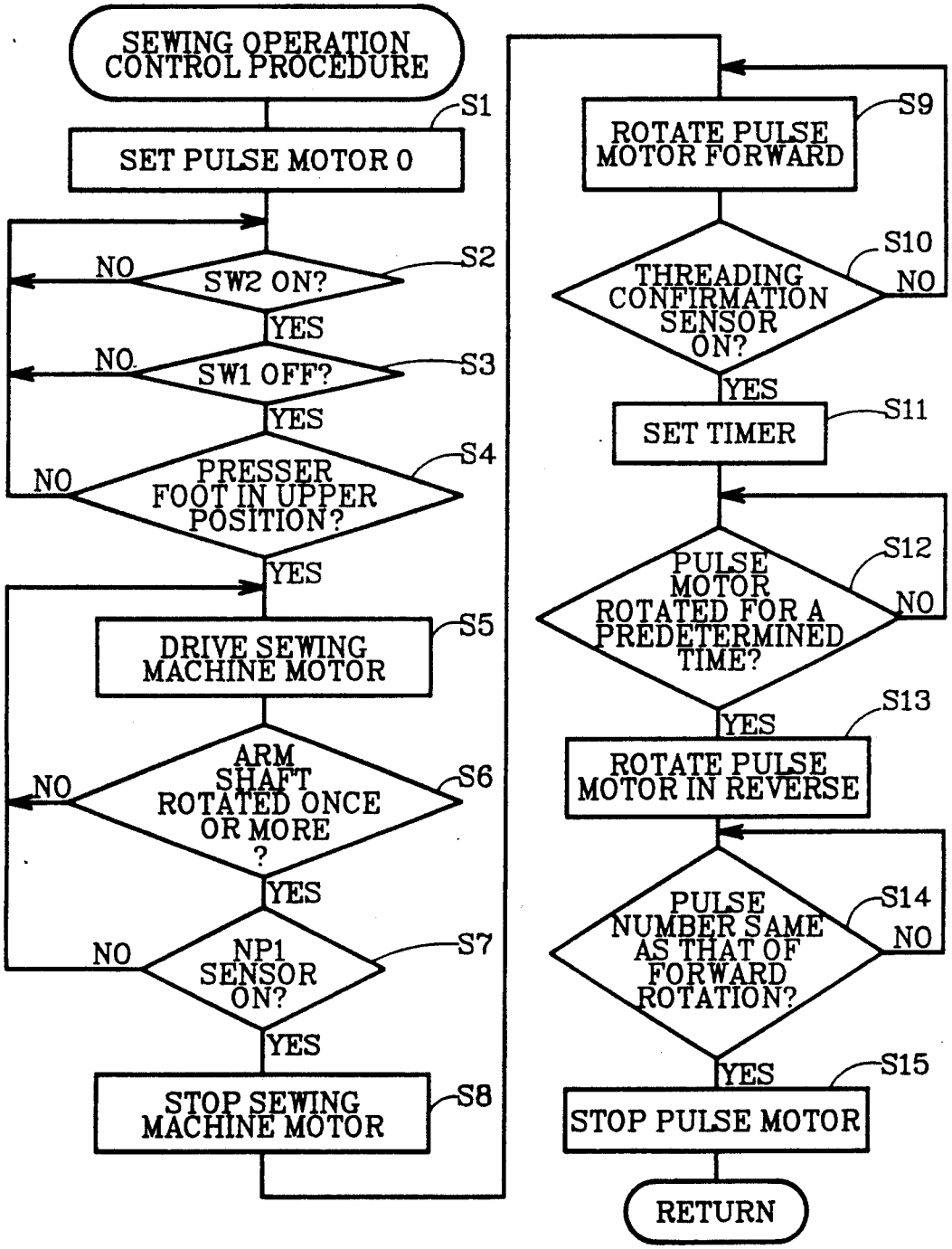
FIG. 12 is a flow chart of the control procedure performed by the control system of FIG. 11.

FIG. 12 is a flow chart showing control procedure executed by the electronic control circuit 120. As described above, the needle thread w as pulled from the bobbin 7 is led to a predetermined position along the guide groove 11. When it is first turned on, the sewing machine is initialized and its motors, including the pulse motor 105, are set to "0" at step S1.

Subsequently, the threading switch SW2 is pressed by an operator to begin the fully automatic threading operation of this invention. When it is determined at step S2 that the threading switch SW2 is on, it is asked at the next step S3 whether the start switch SW1 is off or not. When the answer is affirmative, the electronic control circuit 120 proceeds to step S4, where it is asked whether the presser foot 112 is in its upper position and the tension member 13 is opened. When the start switch SW1 is on or when the presser foot 112 is not raised, the procedure goes back to step S2. The threading switch SW2 must be pressed again when the answer at step S3 or step S4 is negative, because the threading switch SW2 momentarily operates.

When the start switch SW1 is off and the presser foot 112 is in its upper position, the sewing machine motor 125 is driven at step S5.

Figure 13C:
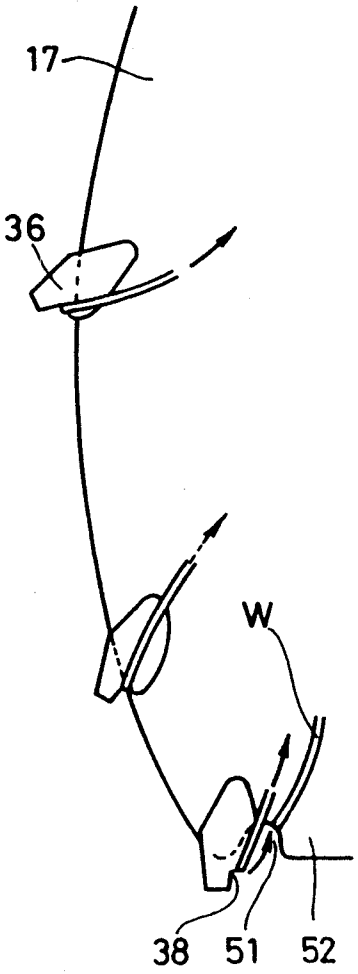
FIG. 13A through 13C explain the thread taking-up operation performed by the thread take-up.
Figure 13B:
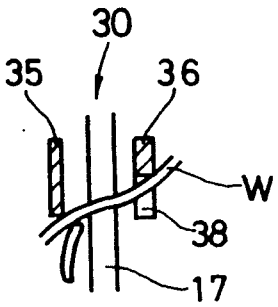
Figure 13A:
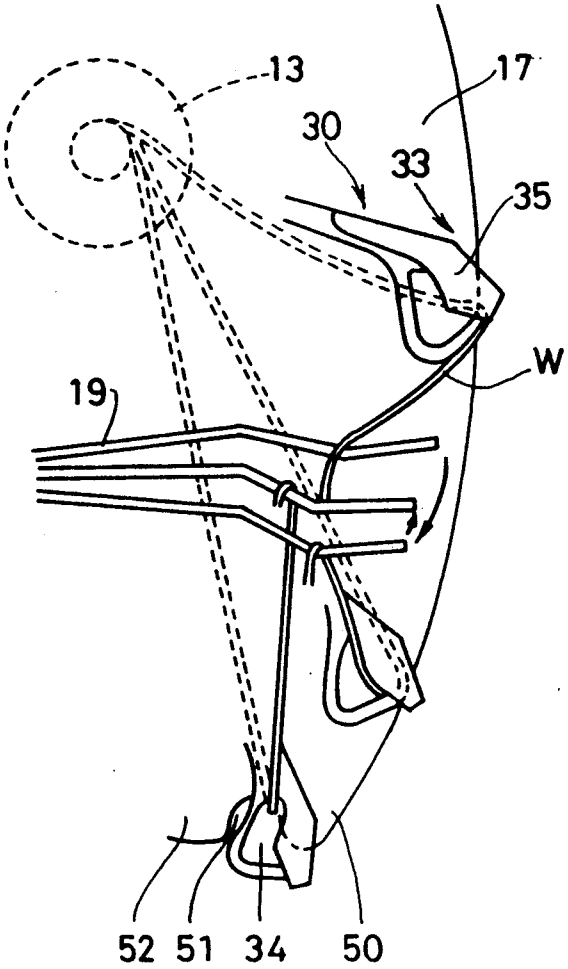

When the sewing machine motor 125 is driven, the needle thread w is taken up by the thread take-up 30, as shown in FIGS. 13A through 13C.

When the thread take-up 30 is swung downward, the needle thread w crossing almost the middle portion of the thread guide 17 is caught by the pressing cover 33 provided at the end of the thread take-up 30. The needle thread w abuts the under sides of the front panel 35 and the notch 38 of the rear panel 36. As the thread take-up 30 is further swung downward, the thread take-up 30 pulls the needle thread w along the thread guide 17. At this time, the needle thread w continues to be pulled only from the bobbin 7, because the free end of the needle thread w is gripped by the thread end keeping member 70 and the tension member 13 is opened.

The thread take-up 30 continues to move downward until it is below the lower end portion 50 of the thread guide 17. After that, the thread guide 17 does not prevent the needle thread w from slipping from between the front panel 35 and the rear panel 36 and entering the thread holding hole 34. In addition, the thread take-up spring 19 leaps up. Consequently, the needle thread w is pulled up, is slipped from the notch 38 of the pressing cover 33, and enters the dent 51 of the thread receiver 52 and the thread holding hole 34. The needle thread w never goes up beyond the lower end portion 50 even when the thread take-up 30 swings up, because the deepest portion of the thread holding hole 34 is above the lower end portion 50.

The needle thread w is thus taken by the thread take-up 30. Although the needle thread w is caught by the thread take-up 30 after the thread take-up 30 once swings down, the control logic asks at step S6 for confirmation of whether or not the arm shaft 60 rotated once or more such that the needle thread w never fails to be taken regardless of the initial position of the thread take-up 30.

After the sewing machine motor 125 rotates once or more the phase angle of the arm shaft 40 is NP1. Then, it is determined at step S7 whether or not the NP1 sensor 130 output a detection signal. If the answer at step S7 is affirmative, the sewing machine motor 125 is stopped at step S8.

While the arm shaft 40 is rotated by the sewing machine motor 125, the needle bar 21 is driven vertically together with a needle bar connecting stud 144 by a needle-bar crank 142 connected to the end of the crank pin 45 via a connecting board 140, as shown in FIG. 6. As can be seen from the drawing figure, the crank pin 45 passes through the base 43 of the thread take-up 30. When the sewing machine motor 125 is stopped in response to the detection signal from the NP1 sensor 130, the needle bar 21 is placed in the vicinity of its highest position. Accordingly, when the needle thread w is threaded through the eye 63 of the needle 62 when the presser foot 112 is raised, the presser foot 112 does not interfere with the thread positioning member 64 and the threading member 65.

Subsequently, the pulse motor 105 is rotated forward at step S9, the rack 100 is lowered, and the needle thread w is threaded through the eye 63 of the needle 62, in the manner shown in FIGS. 10A through 10C and FIGS. 14A through 14C.

As described above, when the pulse motor 105 rotates forward, the threading member shaft 60 is lowered. After the threading hook 90 is just beside the eye 63, further lowering of the threading member shaft 60 is stopped and it is rotated. Consequently, the thread positioning member 64 is stretched out and the first and the second thread tension parts 66 and 67 are positioned to the right of the needle 62 as FIG. 10B is viewed. Under this condition, the needle thread w is mainly pulled from its upstream side and is strung across in front of the eye 63 of the needle 62 because the free end of the needle thread w is pinched and held by the thread end keeping member 70. The needle thread w is led to the under side of the first thread tension member 66 through the space 74 and is positioned near the eye 63.

Figure 14C:
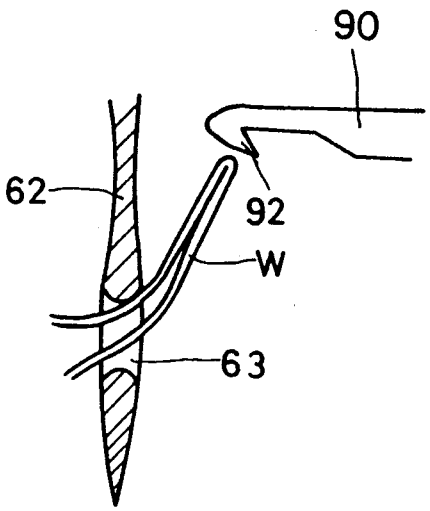
FIG. 14C is a cross-sectional view showing the operation of the threading member.
Figure 14B:
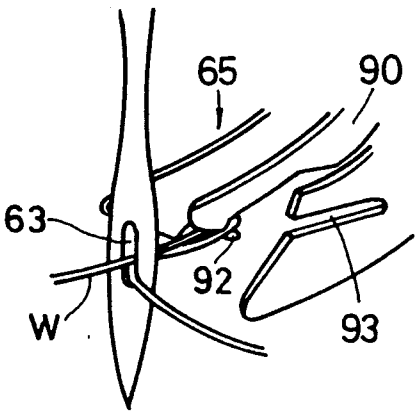
FIG. 14A and 14B are perspective views showing the operation of the threading member.
Figure 14A:
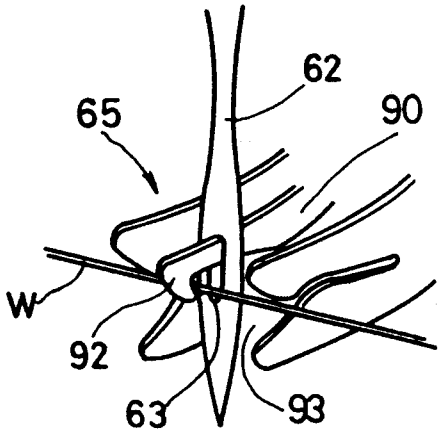

At the same time, the threading member 65 is also rotated causing the threading hook 90 to pass through the eye 63 to the position of FIG. 14A. The needle thread w is guided by the leading notches 93 so as to be caught behind the projection 92.

When the needle thread w is caught by the threading hook 90 through the eye 63, the threading confirmation sensor 136 sends out a signal at step S10. After the threading confirmation sensor 136 turns on, a timer is set at step S11 and the pulse motor 105 is rotated forward until a predetermined time elapses, at step S12. The pulse motor 105 is rotated such that the needle thread w is securely held by the threading hook 90, because the needle thread w fails to be caught by the threading hook 90 in some cases.

After the predetermined time, the number of pulses, C, required for the forward rotation of the pulse motor 105 is stored in a specified memory location in the electronic control circuit 120 for later retrieval. Then the pulse motor 105 is rotated in reverse at step S13. As the threading member shaft 60 is rotated, the thread positioning member 64 is contracted again, the threading member 65 is also rotated, and the threading hook 90 is withdrawn from the eye 63, as depicted in FIG. 10C. As the threading member shaft 60 is further rotated, the engagement pin 97 abuts the lower end of the cam notch 96 and the rotation of the threading member shaft 60 is stopped. The threading member shaft 60 is then raised in combination with the guide member 95.

As depicted in FIGS. 14B and 14C, the needle thread w caught by the threading hook 90 is pulled through the eye 63. At this time, the free end of the needle thread w is released from the support 81 and slips away from between the press plate 80 and press disc 82 along the receiving groove 84, as shown in FIG. 10C.

At step S14 of the control logic, the pulse motor 105 is rotated in reverse the same number of pulses, C, previously stored in memory. The pulse motor 105 is then stopped at step S15.

In the manner described above, according to this invention the needle thread w is automatically taken up by the needle take-up 30 and subsequently threaded through the eye 63 of the needle 62 by an operator simply pressing the threading switch SW1 once. It should be noted that in this embodiment, the thread taking-up operating is executed before the threading operating to prevent the needle thread w from coming out of the eye 63 during the thread taking-up operating. The threading operating can be executed before the thread taking-up operating, however, in the following second embodiment of the present invention.

The structure of a sewing machine for automatic thread taking-up and threading according to the second embodiment is substantially the same as that of the first embodiment described above. Therefore, in the interest of simplicity, similar members to that of the first embodiment are given similar numbers in the drawings and the description which follows.

Figure 15:
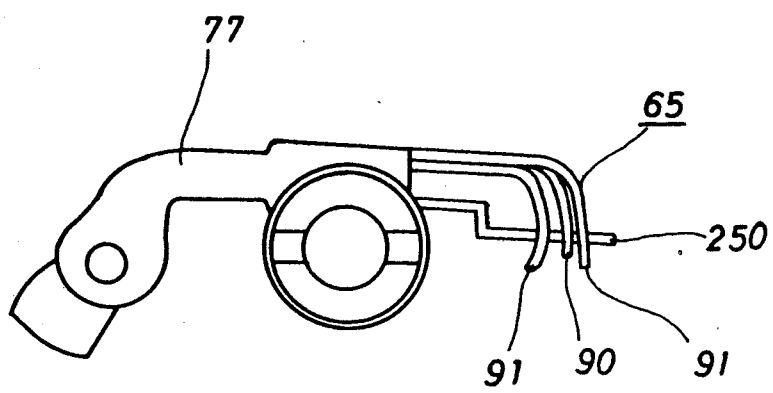
FIG. 15 is a top view of the threading member of a sewing machine for automatic thread taking-up and threading according to the present invention in a second embodiment.
Figure 16A:
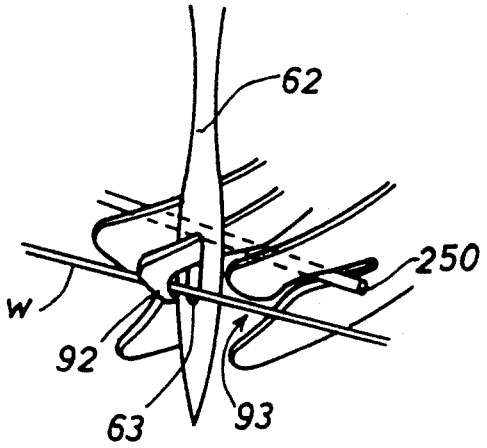
FIG. 16A and 16B are perspective views showing the operation of the threading member of the sewing machine of the second embodiment.
Figure 16B:
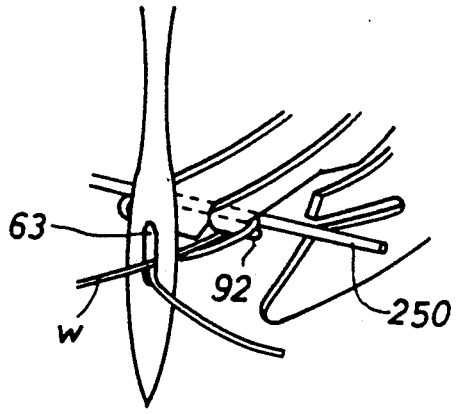
Figure 16C:
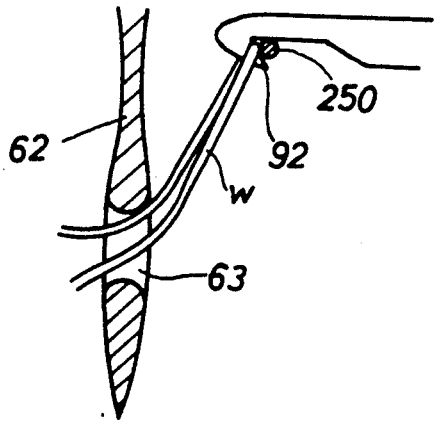
FIG. 16C is a cross-sectional view showing the operation of the threading member.

As best seen in FIGS. 15 and 16A through 16B, an elastic wire 250 is wound around the cylindrical portion of a rotating arm 77 to hold it thereon at one end while its other free end is positioned to penetrate the leading notches 93 of the hook guards 91. The elastic wire 250 is further positioned to abut the rear face of the projection 92 of the threading hook 290 in its normal position. As shown in FIGS. 16A through 16C, when the projection 92 penetrates the eye 63, the elastic wire 250 is forced back by the rear face of the needle 62. As a result, the needle thread w strung before the eye 63 is easily caught by the projection 92. Moreover, when the projection 92 is drawn back, the elastic wire 250 moves forward to abut the rear face of the projection 92 once again as a result of its elasticity, as shown in FIG. 16B.

Thus, the needle tread w is firmly held in its position behind the projection 292 by the elastic wire 250 as it is pulled through the eye 263. As in the first embodiment, the free end of the needle thread w is from the thread end keeping member (not shown) while being pulled through the eye 63. Although the needle tread w may pulled up subsequently because a threading member shaft (not shown) is raised, the elastic wire 250 presses the needle thread w into the rear face of the projection 92 and the needle thread w is thereby securely held by the projection 92. Consequently, when the thread taking-up operating is performed, the needle thread w never comes out of the eye 263.

Figure 17:
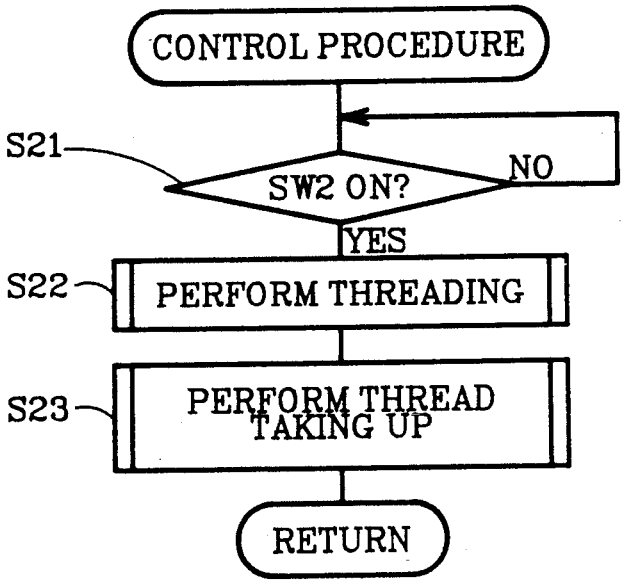
FIG. 17 is a flow chart showing a control procedure for the second embodiment.
Figure 18:
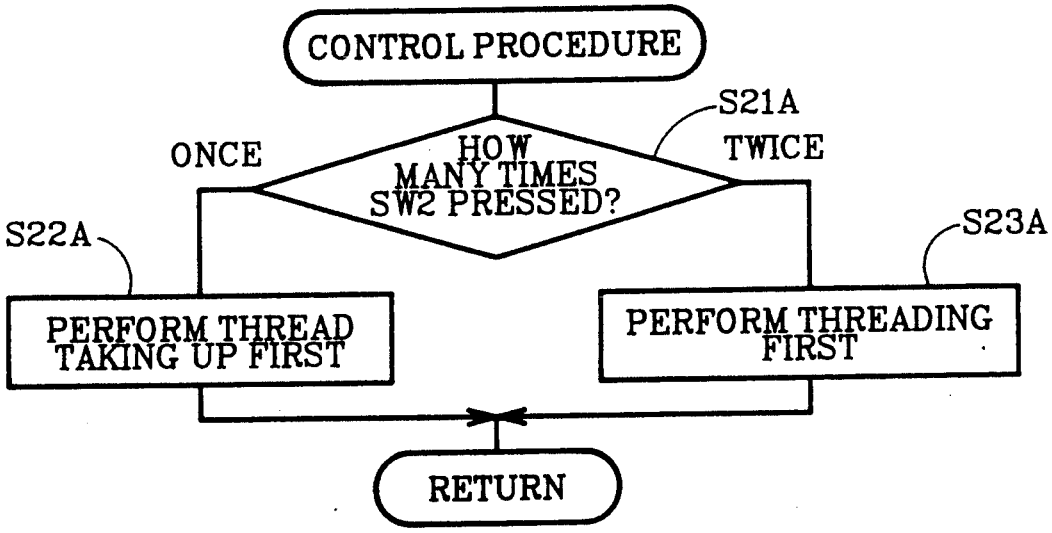
FIG. 18 is a flow chart showing another control procedure for the second embodiment.

FIG. 17 is a flow chart of a control procedure for the second embodiment. When the threading switch SW2 is pressed at step S21, a pulse motor (not shown) is driven and the eye 63 of the needle 62 is threaded at step S22. Subsequently, a sewing machine motor (not shown) is driven and the needle thread w is caught by the thread take-up at step S23. As will be appreciated from the logic of the flowchart, the thread taking-up operation may be performed either before or after the threading operating in the second embodiment at the discretion of the operator. As shown in FIG. 18, when the threading switch SW2 is pressed once within a predetermined time period at step S21A, the thread taking-up operating is performed at step S22A; and, when the threading switch SW2 is pressed twice within the same predetermined time period, the threading operating is performed at step S23A.

The following is an explanation of a sewing machine for automatic thread taking-up and threading according to a the third embodiment of this invention which is provided with a detachment mechanism for detaching a needle bar 21 from an arm shaft during the threading operating.

Figure 19A:
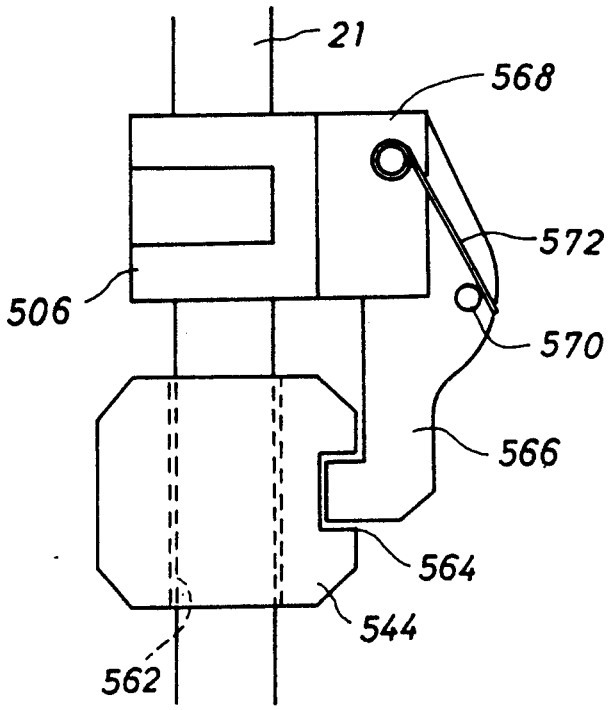
FIG. 19A is a partial side view of a needle bar detachment mechanism of a sewing machine for automatic thread taking-up and threading in a third embodiment of the present invention.
Figure 19B:
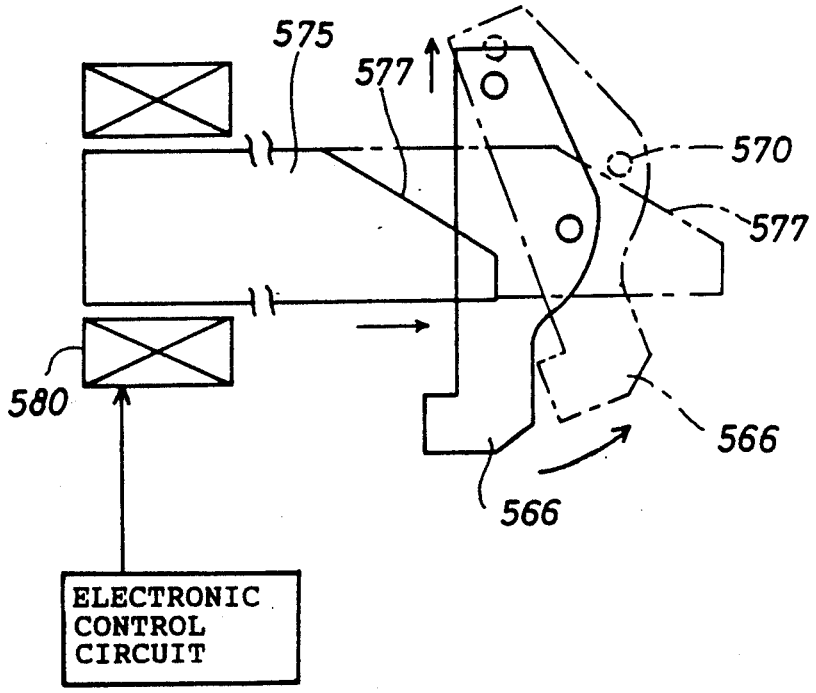
FIG. 19B shows the operation of the needle bar detachment mechanism.

As shown in FIG. 19A, a needle bar connecting stud 544 of the third embodiment has a through hole 562 with a larger diameter than that of the needle bar 21 and an engagement cavity 564 with an appropriate width at its front face. The needle bar connecting stud 544 is movable on the needle bar 21. On the other hand, an abutting member 506 is fixed to the needle bar 21. An engagement protrusion 566 is rotatably connected to a support member 568 attached to the front face of the abutting member 506. When the engagement protrusion 566 engages with the engagement cavity 564 of the needle bar connecting stud 544, the needle bar 21 is vertically moved in response to the rotation of an arm shaft (not shown) as in a usual sewing machine.

A pin 570 is provided almost at the longitudinally middle portion of the engagement protrusion 566. A torsion spring 572, one end of which is fixed to the support member 568, abuts the upper right portion of the pin 570. The engagement protrusion 566 is thus forced to engage with the needle bar connecting stud 544.

The needle bar 21 is detached from the needle bar connecting stud 544 when the pin 570 of the engagement protrusion 566 is pressed from behind by a pressing member 575. The pressing member 575 is provided with a abutting portion 577 at the upper side of its end and moved by an electromagnetic solenoid 580 driven and controlled by an electronic control circuit 520.

When the electromagnetic solenoid 580 is excited, a pressing member 575 moves to the right as depicted in FIG. 10B and pushes up the pin 570 of the engagement protrusion 566. The engagement protrusion 566 is rotated counterclockwise and is moved up along an abutting portion 577. As a result, the needle bar 21 is detached from the needle bar connecting stud 544 and kept in an upper position. After that, the needle bar 21 is not lowered from the upper position even when an engagement pin (not shown) of a threading member shaft (not shown) presses down an abutting member (not shown).

In the third embodiment, the threading operating and the thread taking-up operating are performed at the same time because of the detachment of the needle bar 21.

Figure 20:
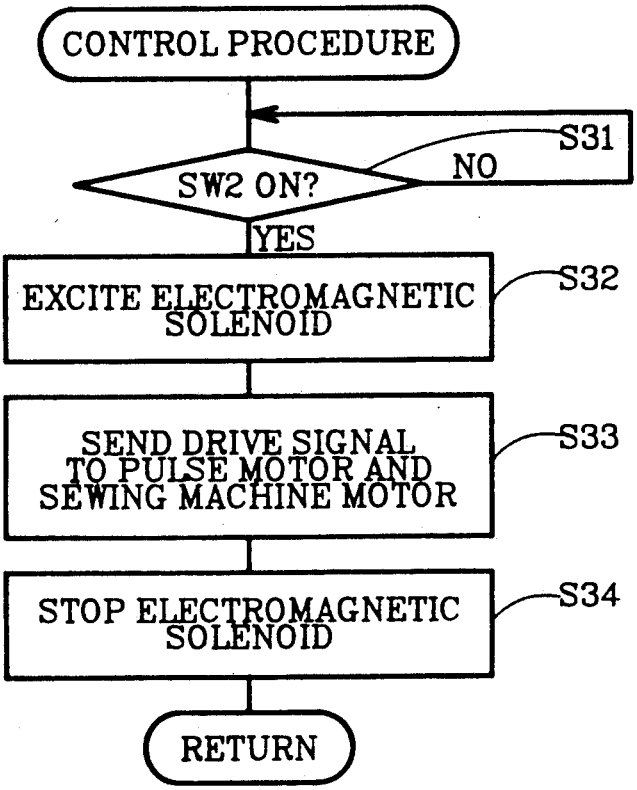
FIG. 20 is a flow chart of a control procedure for use with the third embodiment.

FIG. 20 is a flow chart of a control procedure for the third embodiment. At step S31, it is asked whether the threading switch SW2 is pushed. When the answer is affirmative, the electromagnetic solenoid 580 is subsequently excited and the needle bar 21 is detached from the needle bar connecting stud 544, at step S32. At the next step, S33, drive signals are sent to a pulse motor (not shown) and a sewing machine motor (not shown) at the same time such that the needle thread w is threaded to the eye of the needle and simultaneously taken up by the thread take-up. After it is confirmed that the arm shaft 540 has been rotated once or more and the pulse motor has executed the prescribed forward rotation and backward rotation, the electromagnetic solenoid is stopped being excited at step S34. After this procedure, the pressing member 575 is withdrawn, and the needle bar 21 falls by its own weight and the engagement protrusion 566 is engaged with the engagement cavity 564. Under this condition, the sewing operating can be commenced.

As described above, in the first, second and third embodiments the thread taking-up operating and the threading operating are executed simply by pushing the threading switch SW2. Since the operator does not have to touch several switches, he can easily deal with the sewing machine. In addition, in response to the signal from the threading switch SW2, the electric control circuit 120 controls the thread taking-up operating and the threading operating in a prescribed way. The operator does not have to be experienced in these operations.

Especially in the first and the third embodiments, the operator presses the threading switch SW2 only once, and after that he does not have to touch the needle thread w nor the sewing machine body. Therefore, he may begin other operations, for example, preparation of cloth to be sewn, right after pressing the threading switch SW2. Further, in the third embodiment, since the needle bar 21 is detached from the needle bar connecting stud 544, the needle bar 21 does not go down when the thread is caught by the thread take-up. Accordingly, cloth to be sewn may be placed under the presser foot while the needle thread w is being caught by the thread take-up and being threaded to the eye of the needle after the threading switch SW2 is pressed.

In each embodiment, the needle thread is caught by the thread take-up and threaded to the needle according to the timings of drive signals from the electric control circuit to the pulse motor 105, sewing machine motor 125 and the electromagnetic solenoid 180. Complicated cam mechanism and linkage mechanism are not required. Further, the timings can be adjusted without difficulty.

The threading switch SW2 in each embodiment is provided at the upper left side of the guide groove 11 on the face plate 3. After drawing the needle thread w from the bobbin 7, the operator can move the presser foot lever 110 with his right hand and at the same time press the threading switch SW2 with his left hand. He is unlikely to mistake the threading switch SW2 for the start switch SW1.

The sewing machine motor 125 for thread taking-up, the pulse motor 105 for threading, and the electromagnetic solenoid 180 for detaching the needle bar are all driven by electricity and therefore can share a power source. The sewing machine can be made as small as possible.

Briefly, in each embodiment the operator can hardly operate wrongly and does not have to be experienced in the thread taking-up operating and the threading operating, because he has only to introduce the needle thread w along the guide groove and to press the threading switch SW2 with one hand.

Although three embodiments have been described, the position of the threading switch SW2 is not limited to that described in the embodiments and the threading switch SW2 can be provided at any appropriate position in the sewing machine body or peripheral units.

The mechanisms for the thread taking-up operating and for the threading operating are not limited to those in the embodiments; the needle thread w may be caught by either the thread take-up 30 or the thread receiver 52. On the other hand, the needle thread w does not have to be automatically threaded to the eye of the needle. As disclosed in Japan Published Unexamined Patent Application No. H1-113092, an operator may give a needle thread to a threading hook penetrating an eye of a needle. In the above two modifications, the thread taking-up operating and the threading operating are automatically or semiautomatically executed by pushing the threading switch SW2. The operator does not have to continue to press the threading switch SW2 and therefore can freely use both hands to do other manual operations while the needle thread is taken up and threaded to the needle.

Moreover, the mechanism for the thread taking-up operating and the threading operating does not have to be a button-shaped switch to be pressed, but may be, for example, a lever. In such case, the sewing machine of the second embodiment may be constructed such that a lever is shifted rightward to take up the needle thread by the thread take-up and be shifted leftward to thread the needle.

In the first embodiment, the needle thread w is prevented from slipping out of the eye of the needle, because the thread taking-up operating is executed before the threading operating. However, since the elastic wire 250 shown in the second embodiment keeps the needle thread w at an appropriate position, the thread taking-up operating can be performed after the needle threading operating. The elastic wire 250 of the second embodiment holds the end of the thread w below the thread take-up until the needle thread w is caught by the thread take-up. Therefore, another holding member for holding the needle thread w until the needle thread w being securely taken by the thread take-up may be provided below the thread take-up. Consequently, when a holding member is interposed between the tread take-up 30 and the needle bar thread guide, the thread taking-up operating and the needle threading operating may be executed in a desired order.

The needle bar detachment mechanism is explained as an example. Other types of the needle bar detachment mechanism can be adopted.

Although several embodiments of the present invention have been disclosed and explained, the invention is not to be limited to these embodiments but includes all embodiments and modifications within the scope and spirit of the invention. For example, the needle threading operating may be executed using air pressure as an operating force if desired.

Wherefore, having thus described the present invention, what is claimed is:

1. Apparatus included in a sewing machine to provide automatic thread take-up and threading comprising:

a) needle thread guide means for guiding a needle thread from a needle thread supply source to a threading preparatory position in the vicinity of a needle bar via a thread take-up preparatory position intersecting a thread take-up moving area;

b) thread take-up means for extracting said needle thread at said thread take-up preparatory position along said thread take-up moving area, said thread take-up means including a thread take-up member for taking up a separate loop of needle thread between the supply source and an eye of a needle;

c) threading means for pulling a loop of said needle thread at said threading preparatory position through an eye of a needle provided at a lower end of said needle bar;

d) signal generating means provided in association with the sewing machine for generating signals when operated by a human operator; and, e) thread take-up and threading control means for controlling said threading means and said thread take-up means in combination in a pre-established timing relationship in response to signals from said signal generating means whereby said threading means pulls a loop of said needle thread through said eye of said needle and said thread take-up member takes up said separate loop of needle thread.

2. The automatic thread take-up and threading apparatus for a sewing machine of claim 1 wherein said threading means comprises:

a) a pair of spaced positioning members disposed on opposite sides of said needle adjacent said eye, each of said positioning members having a guide slot means in a free end thereof positioned for receiving said needle thread and for guiding it across said eye of said needle; and, b) a thread gripping member disposed between said pair of spaced positioning members and having a free end sized and positioned to pass through said eye of said needle, said thread gripping member including releasable gripping means for, after passing through said eye of said needle, gripping said needle thread and pulling a loop of said needle thread back through said eye of said needle.

3. The automatic thread take-up and threading apparatus for a sewing machine of claim 2 wherein:

a) said gripping means comprises a projection forming a notch for receiving said needle thread; and, b) said thread take-up means includes means for releasing a gripped free end of said needle thread whereby said needle thread comes out of said notch with said needle thread threaded through said eye of said needle.

4. The automatic thread take-up and threading apparatus for a sewing machine of claim 3 and additionally comprising:

supplemental gripping means for holding said needle thread in said notch as said needle thread is pulled through said eye of said needle.

5. The automatic thread take-up and threading apparatus for a sewing machine of claim 1 and additionally comprising:

a) said signal generating means including a start switch and a threading switch; and, b) said thread take-up and threading control means including electronic control circuit means for controlling said threading means and said thread take-up means in combination in said pre-established timing relationship wherein said start switch and said threading switch are connected at an input side of said electronic control circuit and a sewing machine motor and a pulse motor are connected at an output side of said electronic control circuit via a sewing machine motor driver and a pulse motor driver;

c) a NP1 sensor connected to said input side of said electronic control circuit, said NP1 sensor being positioned to send out a detection signal when said needle bar is at a highest position, "NP1";

d) a NP2 sensor connected to said input side of said electronic control circuit, said NP2 sensor being positioned to send out a detection signal when a thread take-up portion of said thread take-up means is at a highest position, "NP2";

e) a presser-foot upper position sensor connected to said input side of said electronic control circuit and being positioned to send out a detection signal when a presser foot of the sewing machine is raised causing a tension member holding said needle thread on a supply side to open; and, f) a threading confirmation sensor connected to said input side of said electronic control circuit and being positioned to send out a detection signal when an upper end of a threading member shaft projects beyond a predetermined position.

6. The automatic thread take-up and threading apparatus for a sewing machine of claim 5 wherein said electronic control circuit means includes logic for performing the steps of:

a) initializing the sewing machine and motors thereof including setting the pulse motor to "0", when the sewing machine is first turned on by means of said start switch;

b) first determining if said start switch has been released and said presser foot is raised and the tension member is open when said threading switch is pressed by an operator to begin a fully automatic threading operation, and only proceeding to the next step when the condition is satisfied;

c) applying power to said sewing machine motor to cause said needle thread to be taken up by a thread take-up;

d) determining that an arm shaft has rotated once or more such that said NP1 condition is achieved;

e) stopping said sewing machine motor is a NP1 signal is received.

7. The automatic thread take-up and threading apparatus for a sewing machine of claim 6 wherein said electronic control circuit means additionally includes logic for performing the steps of:

rotating said pulse motor forward a number of pulses, C, and backwards the same number of pulses, C, after said sewing machine motor has been stopped in response to a detection signal from said NP1 sensor, whereby said needle thread is threaded through said eye of said needle.

8. The automatic thread take-up and threading apparatus for a sewing machine of claim 7 and additionally comprising:

a) a threading member shaft mounted for lowering and raising and for rotation in a lowered position by said pulse motor;

b) a threading hook carried by said threading member and positioned adjacent said eye of said needle when said threading member is in said lowered position;

c) linkage means for lowering said threading member shaft when said pulse motor rotates forward, and rotating said threading member shaft after said threading hook is just beside said eye, whereby, c1) a thread positioning member is stretched out and first and second thread tension parts thereof are positioned to an outside point of said needle and said needle thread is pulled from an upstream side and is strung across in front of said eye of said needle as a result of a free end of said needle thread being pinched and held by a thread end keeping member, c2) said needle thread is led to an under side of a first thread tension member and positioned near said eye of said needle whereby, c3) when said threading member is rotated in a first direction a thread hook passes through said eye and catches said needle thread behind a projection thereof and when, c4) said threading member is rotated in a second direction opposite said first direction, said threading hook is withdrawn from said eye of said needle thereby pulling a loop of said needle thread through said eye of said needle, and c5) a free end of said needle thread is released.

9. In a sewing machine having a sewing head carrying a needle bar vertically driven by a sewing motor and having a sewing needle with an eye therethrough vertically mounted on a bottom end for vertical motion therewith, automatic thread take-up and threading apparatus comprising:

a) needle threaded guide means for guiding a needle thread from a needle thread supply source to a threading preparatory position in the vicinity of the needle bar via a thread take-up preparatory position intersecting a thread take-up moving area;

b) thread take-up means for extracting said needle thread at said thread take-up preparatory position along said thread take-up moving area, said thread take-up means including a thread take-up member for taking up a separate loop of needle thread between the supply source and the eye of the needle;

c) threading means for pulling a loop of the needle thread at said threading preparatory position through the eye of the needle;

d) signal generating means provided in association with the sewing machine for generating signals when operated by a human operator; and, e) thread take-up and threading control means for controlling said threading means and said thread take-up means in combination in a pre-established timing relationship in response to signals from said signal generating means whereby said threading means pulls a loop of the needle thread through the eye of the needle and said thread take-up member takes up said separate loop of needle thread.

10. The automatic thread take-up and threading apparatus for a sewing machine of claim 9 wherein said threading means comprises:

a) a pair of spaced positioning members disposed on opposite sides of the needle adjacent the eye, each of said positioning members having a guide slot means in a free end thereof positioned for receiving the needle thread and for guiding it across the eye of the needle; and, b) a thread gripping member disposed between said pair of spaced positioning members and having a free end sized and positioned to pass through the eye of the needle, said thread gripping member including releasable gripping means for, after passing through the eye of the needle, gripping the needle thread and pulling a loop of the needle thread back through the eye of the needle.

11. The automatic thread take-up and threading apparatus for a sewing machine of claim 10 wherein:

a) said gripping means comprises a projection forming a notch for receiving the needle thread; and, b) said thread take-up means includes means for releasing a gripped free end of the needle thread whereby the needle thread comes out of said notch with the needle thread threaded through the eye of the needle.

12. The automatic thread take-up and threading apparatus for a sewing machine of claim 11 and additionally comprising:

supplemental gripping means for holding said needle thread in said notch as said needle thread is pulled through said eye of said needle.

13. The automatic thread take-up and threading apparatus for a sewing machine of claim 9 and additionally comprising:

a) said signal generating means including a start switch and a threading switch; and, b) said thread take-up and threading control means including electronic control circuit means for controlling said threading means and said thread take-up means in combination in said pre-established timing relationship wherein said start switch and said threading switch are connected at an input side of said electronic control circuit and a sewing machine motor and a pulse motor are connected at an output side of said electronic control circuit via a sewing machine motor driver and a pulse motor driver;

c) a NP1 sensor connected to said input side of said electronic control circuit, said NP1 sensor being positioned to send out a detection signal when the needle bar is at a highest position, "NP1";

d) a NP2 sensor connected to said input side of said electronic control circuit, said NP2 sensor being positioned to send out a detection signal when a thread take-up portion of said thread take-up means is at a highest position, "NP2";

e) a presser-foot upper position sensor connected to said input side of said electronic control circuit and being positioned to send out a detection signal when a presser foot of the sewing machine is raised causing a tension member holding the needle thread on a supply side to open; and, f) a threading confirmation sensor connected to said input side of said electronic control circuit and being positioned to send out a detection signal when an upper end of a threading member shaft projects beyond a predetermined position.

14. The automatic thread take-up and threading apparatus for a sewing machine of claim 13 wherein said electronic control circuit means includes logic for performing the steps of:

a) initializing the sewing machine and motors thereof including setting the pulse motor to "0", when the sewing machine is first turned on by means of said start switch;

b) first determining if said start switch has been released and said presser foot is raised and the tension member is open when said threading switch is pressed by an operator to begin a fully automatic threading operation, and only proceeding to the next step when the condition is satisfied;

c) applying power to said sewing machine motor to cause said needle thread to be taken up by a thread take-up;

d) determining that an arm shaft has rotated once or more such that said NP1 condition is achieved;

e) stopping said sewing machine motor is a NP1 signal is received.

15. The automatic thread take-up and threading apparatus for a sewing machine of claim 14 wherein said electronic control circuit means additionally includes logic for performing the steps of:

rotating said pulse motor forward a number of pulses, C, and backwards the same number of pulses, C, after said sewing machine motor has been stopped in response to a detection signal from said NP1 sensor, whereby the needle thread is threaded through the eye of the needle.

16. The automatic thread take-up and threading apparatus for a sewing machine of claim 15 and additionally comprising:

a) a threading member shaft mounted for lowering and raising and for rotation in a lowered position by said pulse motor;

b) a threading hook carried by said threading member and positioned adjacent the eye of the needle when said threading member is in said lowered position;

c) linkage means connected for when said pulse motor rotates forward, lowering said threading member shaft and after said threading hook is just beside the eye rotating said threading member shaft whereby, c1) a thread positioning member is stretched out and first and second thread tension parts thereof are positioned to an outside point of the needle and the needle thread is pulled from an upstream side and is strung across in front of the eye of the needle as a result of a free end of the needle thread being pinched and held by a thread end keeping member, c2) the needle thread is led to an under side of a first thread tension member and positioned near the eye of the needle, c3) said threading member is rotated in a first direction causing a threading hook to pass through the eye and catch the needle thread behind a projection thereof, c4) said threading member is rotated in a second direction opposite said first direction causing said threading hook to be withdrawn from the eye of the needle and pull a loop of the needle thread through the eye of the needle, and c5) a free end of the needle thread is released.

17. In a sewing machine having a sewing head carrying a needle bar vertically driven by a sewing motor and having a sewing needle with an eye therethrough vertically mounted on a bottom end for vertical motion therewith, automatic thread take-up and threading apparatus comprising:

a) needle thread guide means for guiding a needle thread from a needle thread supply source to a threading position adjacent the eye of the needle;

b) first gripping means for gripping free end of the needle thread adjacent said threading position;

c) threading means for reaching through the eye and for pulling a loop of the needle thread through the eye of the needle;

d) grip release means for releasing said free end from said first gripping means;

e) thread take-up means for catching and taking up a separate loop of needle thread between the supply source and the eye of the needle;

f) signal generating means provided in association with the sewing machine for generating signals when operated by a human operator; and, g) thread take-up and threading control means for controlling said threading means and said thread take-up means in combination in a pre-established timing relationship in response to signals from said signal generating means whereby said threading means pulls a loop of the needle thread through the eye of the needle and said thread take-up member takes up said separate loop of needle thread.

18. The automatic thread take-up and threading apparatus for a sewing machine of claim 17 wherein said threading means comprises:

a) a pair of spaced positioning members disposed on opposite sides of the needle adjacent the eye, each of said positioning members having a guide slot means in a free end thereof positioned for receiving the needle thread and for guiding it across the eye of the needle; and, b) a thread gripping member disposed between said pair of spaced positioning members and having a free end sized and positioned to pass through the eye of the needle, said thread gripping member including releasable gripping means for, after passing through the eye of the needle, gripping the needle thread and pulling a loop of the needle thread back through the eye of the needle.

19. The automatic thread take-up and threading apparatus for a sewing machine of claim 18 wherein:

said gripping means comprises a projection forming a notch for receiving the needle thread.

20. The automatic thread take-up and threading apparatus for a sewing machine of claim 19 and additionally comprising:

supplemental gripping means for holding said needle thread in said notch as said needle thread is pulled through said eye of said needle.

* * * * *